US006886274B2

(12) United States Patent
Krafsur et al.

(10) Patent No.: US 6,886,274 B2
(45) **Date of Patent: *May 3, 2005**

(54) SPRING CUSHIONED SHOE

(75) Inventors: David S. Krafsur, Loveland, CO (US); Francis E. LeVert, Knoxville, TN (US)

(73) Assignee: Shoe Spring, Inc., Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/370,638

(22) Filed: Feb. 20, 2003

(65) Prior Publication Data

US 2003/0163933 A1 Sep. 4, 2003

Related U.S. Application Data

(63) Continuation-in-part of application No. 10/192,423, filed on Jul. 10, 2002, now abandoned, which is a continuation of application No. 09/902,236, filed on Jul. 10, 2001, now abandoned, which is a continuation of application No. 09/419,330, filed on Oct. 15, 1999, now Pat. No. 6,282,814

(60) Provisional application No. 60/131,658, filed on Apr. 29, 1999.

(51) Int. Cl.[7] ..... A43B 13/28

(52) U.S. Cl. ..... 36/27

(58) Field of Search ..... 36/7.8, 27, 28, 36/38

(56) References Cited

U.S. PATENT DOCUMENTS 1,471,042 A * 10/1923 Lewis ..... 36/38
1,502,087 A * 7/1924 Bunns ..... 36/28
2,444,865 A 7/1948 Warrington
2,447,603 A 8/1948 Snyder
3,822,490 A 7/1974 Murawski
4,492,046 A 1/1985 Kosova
4,592,153 A 6/1986 Jacinto
4,815,221 A 3/1989 Diaz
4,901,987 A * 2/1990 Greenhill et al. ..... 267/166
5,269,081 A 12/1993 Gray
5,343,636 A 9/1994 Sabol
5,435,079 A 7/1995 Gallegos
5,437,110 A 8/1995 Goldston et al.
5,502,901 A 4/1996 Brown
5,511,324 A 4/1996 Smith
5,517,769 A 5/1996 Zhao
5,544,431 A 8/1996 Dixon
5,743,028 A 4/1998 Lombardino
5,875,567 A 3/1999 Bayley
5,896,679 A 4/1999 Baldwin
5,916,071 A 6/1999 Lee
6,282,814 B1 * 9/2001 Krafsur et al. ..... 36/27

* cited by examiner

*Primary Examiner*—Ted Kavanaugh
(74) *Attorney, Agent, or Firm*—Pitts & Brittian, P.C.

(57) ABSTRACT

A sole assembly for an article of footwear comprises a sole having a heel region and a ball region. A first multi-turn wave spring disposed within the sole comprises an upper turn and a lower turn. The upper turn is in pivotal contact with the lower turn to define a first side and an opposing second side of the multi-turn wave spring. Compression of the first side causes expansion pressure on the second side and compression of the second side causes expansion pressure on the first side to provide cushioning and energy return responsive to a rolling footstrike.

11 Claims, 5 Drawing Sheets

SPRING CUSHIONED SHOE

CROSS-REFERENCE TO RELATED APPLICATIONS

This application is a continuation in part of our application Ser. No. 10/192,423, filed Jul. 10, 2002 now abandoned, which is a continuation of application Ser. No. 09/902,236, filed Jul. 10, 2001 now abandoned, which is a continuation of application Ser. No. 09/419,330, filed Oct. 15, 1999, now U.S. Pat. No. 6,282,814, which, pursuant to 35 USC Section 119, claims the benefit of priority from Provisional Application Ser. No. 60/131,658 with a filing date of Apr. 29, 1999.

STATEMENT REGARDING FEDERALLY SPONSORED RESEARCH OR DEVELOPMENT

Not Applicable

BACKGROUND OF THE INVENTION

1. Field of Invention

This invention relates to the use of wave springs to cushion a shoe. Wave springs allow for reduced impact on the user during foot strike, thus increasing comfort and decreasing injury. Also, the wave springs will return a portion of the impact energy to the user for more efficient jumping, walking and/or running.

2. Description of the Related Art

People involved in normal exercise programs are always seeking new equipment that can minimize the risk of injury to parts of the body caused by stress due to a foot strike. Athletes are also continually looking for ways to improve their performance levels in a variety of athletic and aerobic events that involve walking, running, or jumping while, at the same time, taking steps to reduce the wear and tear attendant to the pounding endured by joints and bones. This can be achieved to some degree by the use of improved sporting equipment and more specifically improved shoes for both athletes and non-athletes.

When participating in sports, especially high impact sports such as volleyball and basketball, the foot of the participant, specifically the ball and heel areas, are prone to extreme mechanical stress due to the force that will be imparted when the foot strikes a relatively incompressible surface. This force, which will vary depending on the type of activity that a person is involved in and the mass of the person, can be as large as five times the body weight of the participant. The reaction force resulting from contact with a non-yielding surface causes great shock to the body that can injure the lower back and all rotating joints of the leg.

Unlike events that involve jumping, the mechanics of running or walking involve a prescribed set of motions insofar as the foot is concerned. Except in those events that involve sprinting, the heel impacts the ground first, the weight then shifts forward onto the ball of the foot in a rolling manner with the toe region providing the last contact with the ground. The initial impact in the heel area is of special interest with non-sprinting runners because it is here that landing forces come into play. It is desirable to absorb as much impact energy as possible, consistent with providing a stable landing and without slowing down the runner. It is also desirable to avoid the complete loss of energy absorbed by the shoe at impact. Also, since the ball and toe areas of the foot are the last to leave the surface in contact with the ground, it is desirable to recover some of the landing energy absorbed in the initial impact. A number of patents related to shoe constructions, which are variously designed to address one or more of the desirable shoe features discussed above, are reviewed below.

U.S. Pat. No. 5,896,679 discloses an article of footwear with a spring mechanism located in the heel area of a shoe, including two plates connected one to the other, and attachment to the lower surface of the shoe sole. The invention of the '679 patent provides a heel mechanism that absorbs the shock or impact foot strikes. U.S. Pat. No. 5,743,028 (T. D. Lombardino) discloses a plurality of vertically oriented compression springs located in the heel area of a running shoe. The springs of the '028 patent are housed in a hermetically sealed unit filled with a pressurized gas that, in combination with the springs, provides a shock absorbing and energy return system. The springs have a substantially coiled appearance in which each spiral coil must provide a torsional spring force and collapse in a vertical stack commonly called the solid height when totally compressed. Because of their design, these springs must have significant free heights to accommodate large deflections. U.S. Pat. No. 4,815,221 (Diaz) discloses an energy control system including a spring plate having a plurality of spring projections distributed over the surface of the plate, which is placed in a vacuity formed within the mid-sole of an athletic shoe. U.S. Pat. No. 5,511,324 (R. Smith) discloses a shoe in which a coil spring extends through a hole in the heel area of the wedge sole of an athletic shoe. U.S. Pat. No. 5,437,110 (Goldston, et al.) discloses an adjustable shoe heel spring and stabilizer device for a running shoe, including a spring mechanism disposed in the mid-sole of the shoe. The shoe heel spring includes a cantilevered spring member and an adjustable fulcrum. A shoe designed specifically for jumping is disclosed in U.S. Pat. No. 5,916,071 (Y. Y. Lee). Lee discloses a shoe mounted on a frame containing a coil spring that extends horizontally from the regions of the frame located at the toe and heel areas of the shoe. The coil spring expands and contracts during walking and jumping. U.S. Pat. No. 4,492,046 (Kosova) discloses a running shoe that includes a spring wire located in a longitudinal slot in the shoe sole, extending from the back edge thereof into the arch region. U.S. Pat. No. 2,447,603 (Snyder) discloses a U-shaped spring plate disposed between the heel of the shoe and a rear portion of the shoe sole. Several other U.S. patents of related art are: U.S. Pat. No. 5,875,567 (R. Bayley); U.S. Pat. No. 5,269,081 (Gray); U.S. Pat. No. 2,444,865 (Warrington); U.S. Pat. No. 3,822,490 (Murawski); U.S. Pat. No. 4,592,153 (Jacinta); and, U.S. Pat. No. 5,343,636 (Sabol); U.S. Pat. No. 5,435,079 (Gallegos); U.S. Pat. No. 5,502,901 (Brown); U.S. Pat. No. 5,517,769 (Zhao); and U.S. Pat. No. 5,544,431 (Dixon).

Revisiting and expanding the above mentioned desirable attributes of a shoe of this type, there is a need for a shoe that enhances the performance of the wearer by providing a substantial spring force working through a significant distance while requiring a minimum volume for deployment. In addition there is a need for a shoe design that also assists in propelling the foot off the ground while still maintaining sufficient lateral stability of the shoe for quick side-to-side movement of the wearer. This performance enhancement can be achieved by temporarily storing the shock energy imparted by foot strike and returning a substantial amount of the energy to the wearer's foot during the propelling-off portion of the stride. Also, there is a need to assure adequate spring fatigue life by limiting maximum stresses and preventing compression to the spring's solid height.

The prior art cited above has disclosed spring devices in athletic shoes for the purposes of absorbing shock and returning energy to the wearer's foot.

As can be seen from the background art, there have been many attempts to add spring cushioning to shoes. However, one only need to look at the current market to see that spring cushioned shoes are not commonly available.

BRIEF SUMMARY OF THE INVENTION

The present invention provides cushioning for a shoe that utilizes wave springs that are placed in the ball and/or heel areas of the sole of a shoe. It should be recognized by one skilled in the art that the placement of the wave springs is not limited to only the ball and heel areas of the shoe. In one embodiment of the present invention, the middle portion sole of the shoe sole assembly is made of foam with vacuities located at or near the ball and heel regions of the foot in order to accommodate placement of the springs. There are also numerous other methods and designs to place the wave springs into a shoe for cushioning and energy return. The ensuing description of the present invention discloses only a limited number of the countless methods and variations thereof that may be used. Advantages of the present invention will become apparent from reading the description of the invention in the embodiments described below.

DETAILED DESCRIPTION

This invention relates to the use of wave springs as an integral part of shoes to cushion the impact of foot strikes and to provide recuperative energy return to the wearer. A spring-cushioned shoe incorporating the various features of the present invention is illustrated generally at 2 in FIGS. 1 and 2. The spring-cushioned shoe 2 shall hereafter be referred to as SCS 2.

Figure 1:
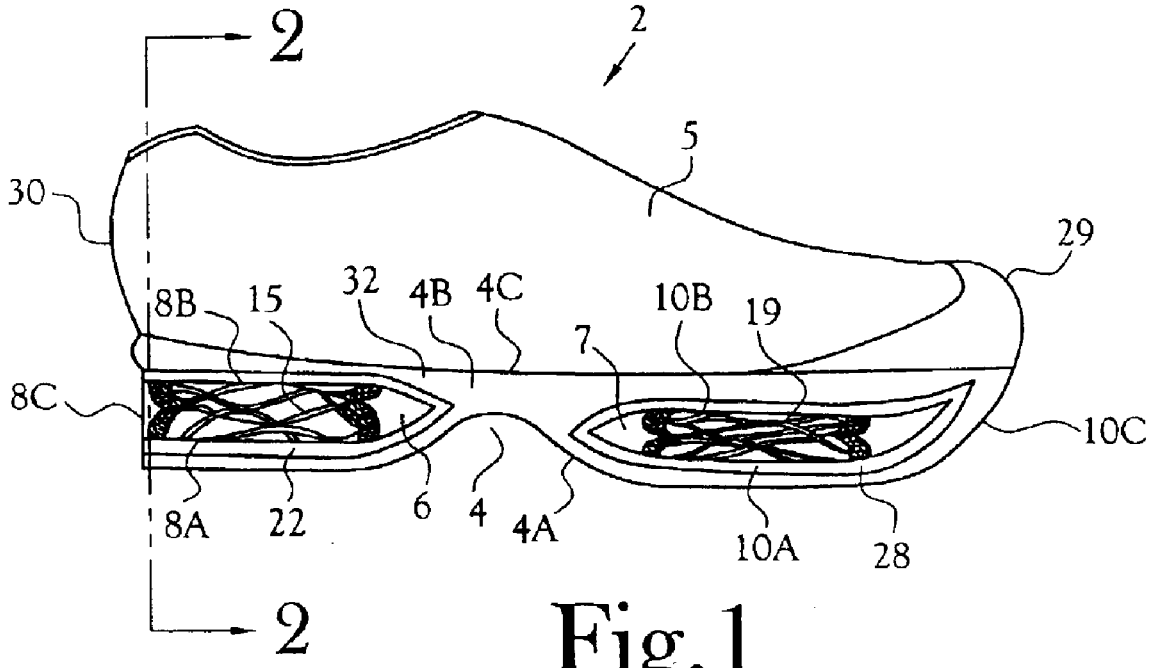
FIG. 1 illustrates a side view of one embodiment of a spring-cushioned shoe.
Figure 2:
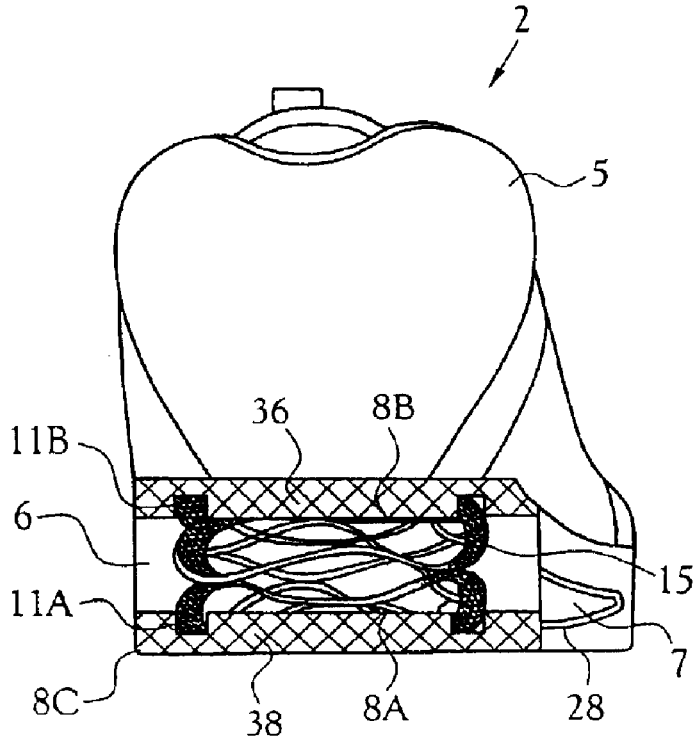
FIG. 2 illustrates a cross sectional view of the spring-cushioned shoe taken in the heel region of the spring cushioned shoe.

The SCS 2 in FIG. 1 comprises: an upper shoe portion 5 firmly attached to shoe sole assembly 4. The shoe sole assembly 4 includes an outer sole 4A with first and second surfaces; middle sole 4B having first and second surfaces positioned such that its first surface is adhesively attached to the second surface of outer sole 4A; and inner sole 4C whose first surface is adhesively attached to the second surface of middle sole 4B and whose second surface is in working contact with the lower region of upper shoe portion 5. In the depicted embodiment, the middle sole 4B is composed of foamed polymeric material, and the inner and outer soles 4A and 4C are made of solid polymeric materials. Particularly, the outer sole 4A is composed of ethyl vinyl acetate with the first surface of outer sole 4A having tractive characteristics. As shown in FIG. 1, the middle sole 4B is designed to define vacuities 6 and 7. Vacuity 6, the extent of which is defined by vertically opposing surfaces 8A and 8B of foamed polymeric material of middle sole assembly 4B, was formed in the heel region 8C of SCS 2. The surfaces 8A and 8B, which are set apart from the second and first surfaces of middle sole 4B, respectively, define thick sections of middle sole 4B at the heel area of the shoe sole assembly 4 into which cylindrical countersunk volumes 11A and 11B, respectively, are formed as shown in FIG.2. Vacuity 7 is disposed between vertically opposing surfaces 10A and 10B of foamed polymeric material 4B in the region 10C of shoe sole assembly 4. Like surfaces 8A and 8B, surfaces 10A and 10B define thick sections of the polymeric material of middle sole 4B located below and above the vacuity 7 in the vertical direction such that cylindrical countersunk volumes, similar to the countersunk volumes 11A and 11B can be formed therein. The cylindrical countersunk volumes provide vertical stabilization and retention of the wave springs 15 and 19. The shoe sole assembly 4 is firmly attached to upper portion 5 of SCS 2. Wave springs 15 and 19 are deployed in vacuities 6 and 7 of foamed polymeric material 4B of shoe sole assembly 4, respectively.

Figure 3:
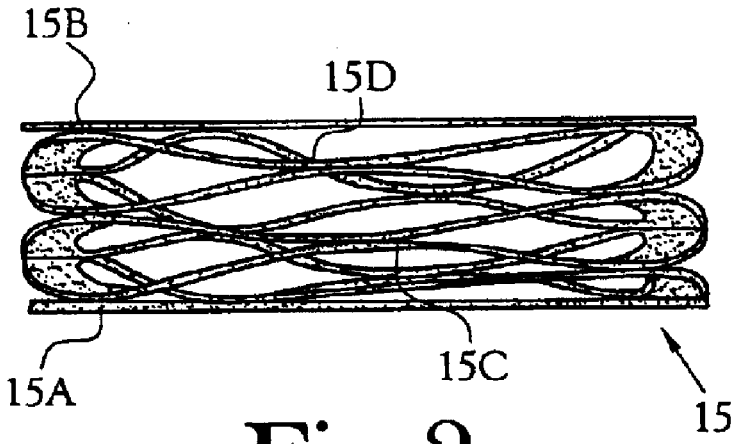
FIG. 3 illustrates a view of the wave spring component of the present invention.

The wave springs 15 and 19 are substantially identical to wave springs described by Greenhill in U.S. Pat. No. 4,901,987. Greenhill describes a multi turn wave spring with distinct crests and troughs. A separate drawing of the wave spring 15 is presented in FIG. 3 for illustrative purposes. Wave spring 15 with circular flat shim ends 15A and 15B and wave crest 15C and wave trough 15D with prescribed periodicity are shown in FIG. 3. FIG. 3 illustrates the configuration of wave springs 15 and 19 which provide for operationally acceptable force and deflection for a given free height of the springs. The wave springs of the preferred embodiment of this invention could be replaced with multi turn wave springs which do not employ flat shim ends but rather rely on the use of flat end plates in combination with ordinary wave springs.

The multi-turn wave spring 15 includes an upper turn 100 and a lower turn 102. The upper turn 100 is in pivotal contact with the lower turn 102 through tangential contact between the trough 104 of the upper turn 100 and the crest 106 of the lower turn 102 and through tangential contact between the trough 108 of the upper turn 100 and the crest 110 of the lower turn 102. The pivotal contact between the crests 106 and 110 with the troughs 104 and 108, respectively, define a first side 110 and a second side 111 of the multi-turn wave spring 15.

It will be recognized by those skilled in the art that the springs 15 and 19 may be formed in non-cylindrical shapes. For example, an oval perimeter can be used for the spring 19 in the ball region 10C to allow improved positioning of the metatarsal bones of the foot, as well as improved flexibility of the shoe.

The cylindrical countersunk volumes 11A and 11B are designed to slidably receive the first and second shim ends 15A and 15B of wave spring 15, respectively, in heel region 8C. When fully inserted, the flat shim ends 15A and 15B of wave spring 15 are held in firm mechanical contact with the closed ends of cylindrical countersunk volumes 11A and 11B, respectively.

Figure 4:
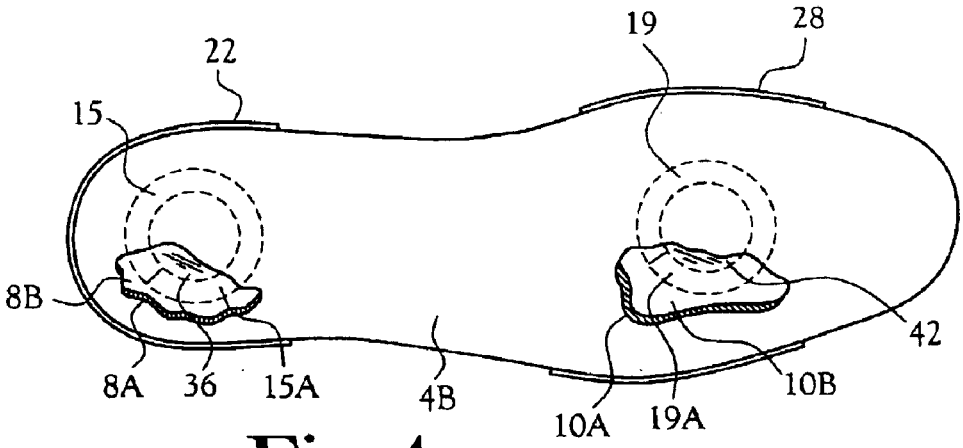
FIG. 4 illustrates a plan view of the outer sole of the spring-cushioned shoe.

The region of shoe sole assembly 4 of the SCS 2 that is normally proximate the metatarsal region of the foot likewise has surfaces 10A and 10B (see FIGS. 1 and 4) that contain similar countersunk cylindrical volumes (not shown) for slidably accepting in the following order the first shim end and the second shim end (not shown), respectively, of wave spring 19. When fully inserted, the shim ends of wave springs 19 are in mechanical contact with the closed end portions of cylindrical volumes. The surfaces 8A and 8B are mechanically held in a manner so as to provide minimal compressive loading on the shim ends 15A and 15B of wave spring 15 by transparent strip 22 (see FIG. 4), which is connected thereto by adhesive. Similarly, transparent strip 28 (see FIG. 4), when adhesively attached to the surfaces 10A and 10B, provides a slight compressive load on shim ends 19A and 19B of wave spring 19. In addition to sealing vacuities 6 and 7 from the environment, strips 22 and 28 provide some lateral stability for the users of the SCS 2. It should be apparent that the strips 22 and 28 could also be made from a number of various materials. In FIG. 1, the upper portion 5 of the SCS 2 is made of high strength synthetic fabric. The materials that comprise the SCS 2 are not limited to only those mentioned in this disclosure. Any number of materials can be used in the manufacturing of the shoes of this invention. The cylindrical countersunk volumes 11A and 11B and similar volumes defined in surfaces 10A and 10B, along with transparent strips 22 and 28, provide for retention and vertical stabilization of the wave springs 15 and 19 when they are inserted into vacuities 6 and 7 respectively.

Referring to the embodiment depicted in FIG. 1, the front end 29, the rear end 30 and the middle region 32 of the shoe sole assembly 4 of the SCS 2 are designed to provide retentive support for wave springs 15 and 19 that augments support provided by transparent strips 22 and 28. Such retentive support consists of strips that connect the shoe sole assembly 4 to the upper shoe portion 5. In FIG. 1, wave springs 15 and 19 are deployed in vacuities 6 and 7 in shoe sole assembly 4, which is attached to shoe upper portion 5. The cross sectional view in FIG. 2 shows interior wave spring compression limiters 36 and 38, which are integral parts of cylindrical countersunk volumes 11A and 11B, respectively. That is, the compression limiter's outer dimensions define the inner diameters of countersunk volumes 11A and 11B, respectively.

The opposing spring compression limiters 36 and 38 (see FIGS. 2 and 4) are separated by the extended wave spring 15 whose solid height when fully compressed by the strike force of the foot of a user is less than the linear distance in the vertical direction between spring compression limiters 36 and 38. The heights of compression limiters 36 and 38 are prescribed by the depth of the countersunk cylindrical volumes 11A and 11B in surfaces 8A and 8B, respectively. In one embodiment of the shoes of the present invention, the distance between the terminal ends of compression limiters 36 and 38 were set at 12 mm. The heights of spring compression limiters 36 and 38 are related mathematically to the spring constant of the wave spring and the mass of the user and are chosen such that the wave spring 15 can not be compressed to its solid height during use. Accordingly, because of the force generated at the portion of shoe sole assembly 4 of the SCS 2 that is normally proximate the metatarsal of the foot during normal use, the distance between the terminal ends of spring compression limiters 42 and 44 is set at 9 mm. The distance between the spring compression limiters of the wave spring 19 and the spring constant of wave spring 19 were selected such that the force generated, when the first surface of shoe sole assembly 4 opposite the ball of the foot contacts a surface while running, cannot compress wave spring 19 to its solid height.

The compression limiters 36 and 38 are used to prevent overstressing of the wave springs 15 and 19, thus increasing the operational life of the springs. Alternatively, the turns of the multi-turn wave springs may be spaced close enough to prevent the spring from compressing to an overstressed state. That is, the wave spring is made with a low profile so that the maximum spring deflection does not reach an overstressed condition.

Wave springs 15 and 19 may be slidably inserted onto lower middle sole compression limiters 38 and 44 while flat plate(s) or even a single lasting board is placed above wave springs 15 and 19 and bonded to the perimeter of the top of the shoe middle sole 4B.

It will be recognized by one skilled in the art that, depending on the weight of the user, the prescribed distances between the terminal ends spring compression limiters will vary. In the present invention, the vacuities 6 and 7 of shoe sole assembly 4 were formed by splitting middle sole 4B into two substantially equal slabs forwardly from the heel area toward the toe of the shoe. The cylindrical countersunk volumes 11A and 11B were formed by machining, at the proper locations and depths, in foam polymeric material of the middle sole 4B. The combined depths of cylindrical countersunk volumes 11A and 11B were selected such that the heights of wave springs 15 and 19 would fill vacuities 6 and 7 at those regions of 4B, when inserted therein. Once wave springs 15 and 19 were inserted in the machined cylindrical countersunk volumes, the split portions of foamed polymeric material of middle sole 4B were adhesively reattached at the middle region of shoe sole assembly 4. The vacuities 6 and 7 are sealed by strips 22 and 28 respectively. The strips 22 and 28 were attached by adhesive to the shoe sole assembly 4 at the heel and ball of the foot regions of the SCS 2. The foamed polymeric material of middle sole 4B could be made from any number of elastic materials such as polyurethane.

The method for forming the vacuities 6 and 7 and fixing the wave springs 15 and 19 in the middle sole 4B of SCS 2 in the present invention was as discussed above. However, it will be apparent to one skilled in the art that the vacuities and spring retention methods could be formed by any number of manufacturing techniques available to the shoe industry, such as the use of a molding process with the springs being inserted into the assembled shoe sole. Alternatively, the complete shoe sole-spring assembly could be made in one single continuous process.

The force of a heel strike is substantially greater than the force of the strike to the ball portion of the foot. Accordingly, the wave spring 15, which primarily provides cushioning during foot strikes, has a free height selected to be greater than that of wave spring 19, which provides primarily liftoff force to the foot of a wearer.

Although the wave springs 15 and 19 used in the shoes of the depicted embodiment of this invention are metallic in construction, it will be recognized by one skilled in the art that the material of the wave springs is not solely limited to metals and that a wide variety of other materials could be used as well. Likewise, the materials used in the other parts of the shoe may be made from any multitude of materials commonly used in the art. While the shoe of this invention uses single leaf crest-to-crest wave springs, interlaced wave springs, as described in U.S. Pat. No. 5,639,074 or commercially available nested wave springs may be used as well. The interlaced and nested wave springs, like the crest-to-crest wave springs, provide the primary desirable characteristics of crest-to-crest wave springs important to the shoe of the invention. That is, like crest-to-crest wave springs, interlaced and nested wave springs provide maximum force and deflection for a given unloaded spring height and provide the cushioning and energy return responsive to a rolling footstrike.

Figure 7:
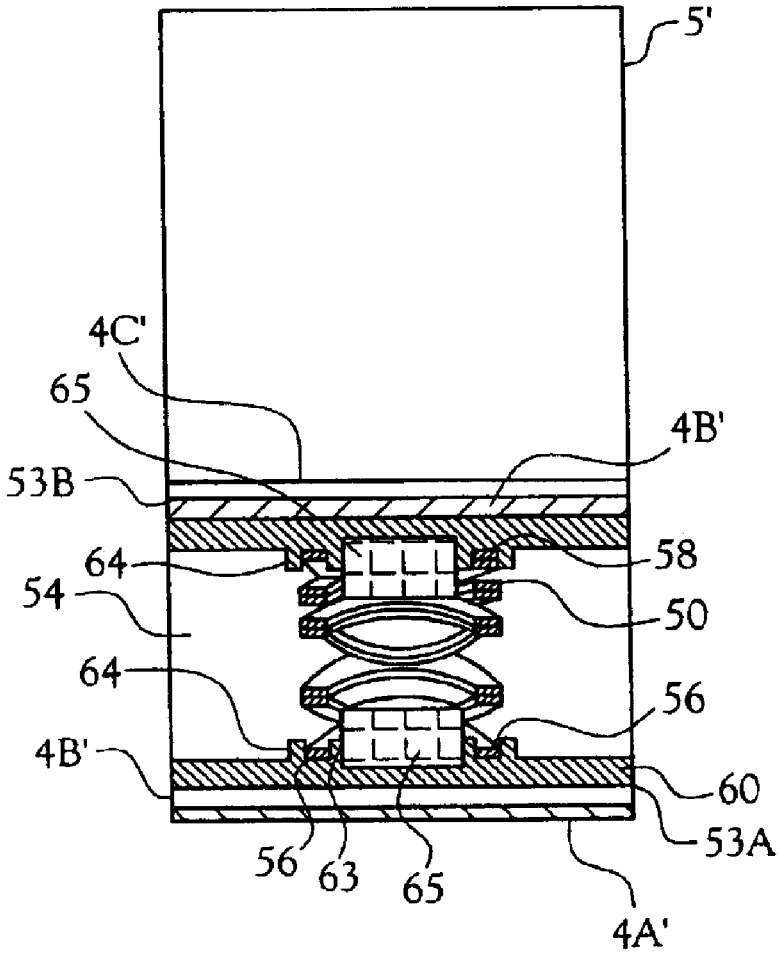
FIG. 7 illustrates a sectional view of one of the spring assemblies of the second embodiment of the spring-cushioned shoe with stabilizer and compression limiter.
Figure 5:
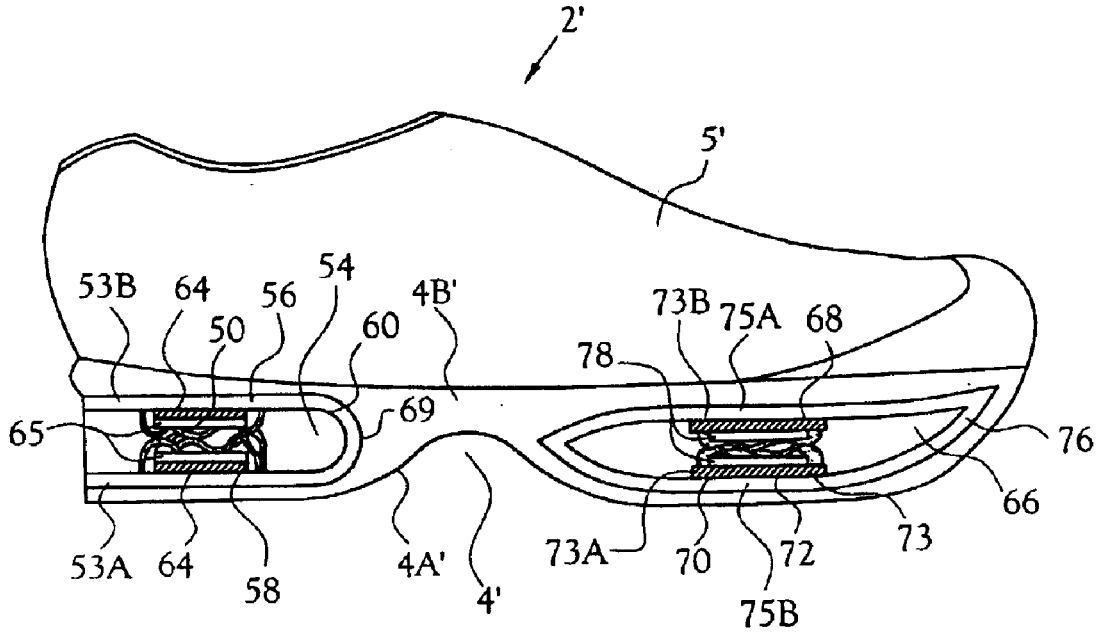
FIG. 5 illustrates a side elevation view of a second embodiment of the spring cushioned shoe.
Figure 6:
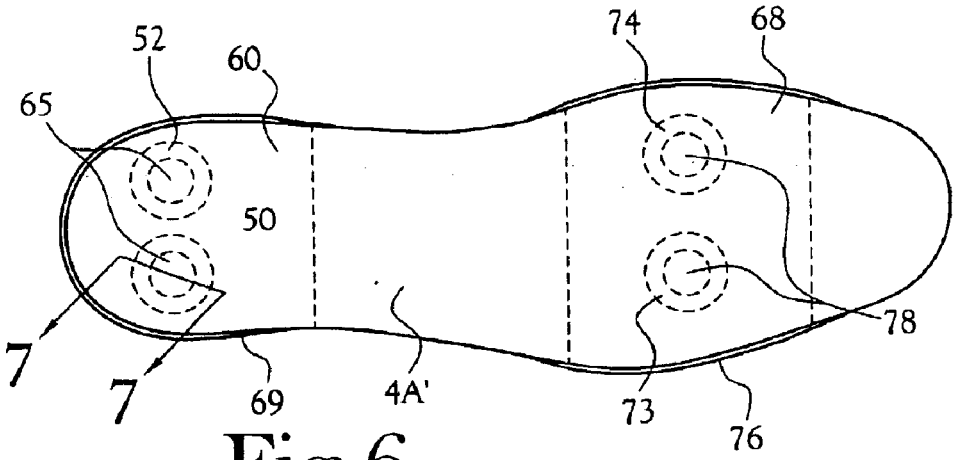
FIG. 6 illustrates a plan view of the outer sole of the second embodiment of the spring-cushioned shoe.
Figure 10:
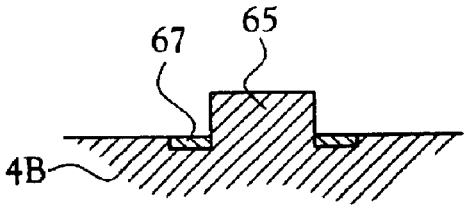
FIG. 10 illustrates an alternative embodiment of the illustration of FIG. 7.

FIG. 5 illustrates a second embodiment of the shoes of this invention. In FIGS. 5 and 6, wave springs 50 and 52 are mounted in vacuity 54 with their first and second terminal shim ends 56 and 58, respectively, mounted in U-shaped plastic receiving clip 60, which includes protrusions 64 as shown in FIG. 7. The protrusions 64 slidably accept the first and second terminal shim ends 56 and 58 of wave springs 50 and 52 to provide firm mechanical contact between the shim ends 56 and 58 and the closed ends 63 of protrusions 64 of U-shaped receiving plate 60. The U-shaped plastic receiving clip 60 containing wave springs 50 and 52 is inserted into vacuity 54 where it is attached, as by adhesive, to the plain interior surfaces 53A and 53B of vacuity 54 in heel area of foamed polymeric material 4B' of shoe sole assembly 4'. The U-shaped plastic-receiving clip 60 is designed to have one pair of cylindrically shaped compression limiters 65 associated with each wave spring. One of the terminal ends of each of the compression limiters 65 is adhesively attached to each of the opposing inner surfaces of clip 60 at the diametrical centers of protrusions 64 by adhesive, as shown in FIG. 7. The U-shaped plastic receiving clip 60 of this second embodiment of the shoes of this invention may be replaced by two plastic plates containing protrusions for slidably accepting the shim ends of one or a multiplicity of wave springs. Alternatively, as depicted in FIG. 10, the ends 67 may be embedded in the middle sole 4B. The vacuity 54 is sealed, as shown in FIGS. 5 and 6, with extensible plastic 69 to provide strength of the SCS 2' in the lateral, or side-to-side, direction during use.

Vacuity 66 is located in the metatarsal region of shoe sole assembly 4'. Plastic plates 68 and 70 include protrusions 72 substantially identical to protrusions 64 of FIG. 7 on their first surface into which the first and second shim ends 73A and 73B of wave springs 73 and the first and second shim ends (not shown) of wave spring 74 (FIG. 6) are slidably inserted. The plastic plates 68 and 70, in addition to the first surfaces, have substantially parallel second surfaces. The assembled unit consisting of plastic plates 68 and 70, protrusions 72 and wave springs 73 and 74 are inserted into vacuity 66 of shoe sole assembly 4'. The second surfaces of plastic plates 68 and 70, with wave springs 73 and 74 inserted therebetween, are attached to the plain interior surfaces 75A and 75B of vacuity 66 by adhesive. The plates 68 and 70 are designed to accept with minimal resistance compression limiters 78 which are attached to diametrical centers of plates 68 and 70 in a manner similar to that of compression limiters 65 to plates 68 and 70. The compression limiters 78 serve to limit the amount of compression that wave springs 73 and 74 can undergo during use. The vacuity 66 is sealed with extensible plastic 76.

It will be recognized by a person of ordinary skill in the art that more than two wave springs may be employed in each of the heel and metatarsal regions the shoes of this invention. A compression limiter, in this second embodiment, is associated with each wave spring. However, one or more strategically positioned pairs of regional compression limiters may be used to limit the compression of a plurality wave springs. Alternatively, a wave spring may be used only in the heel region 8C or only in the ball region 10C.

The spring-cushioned shoe of the second embodiment of this invention contains opposing plates, which are separated by intervening foam material shown in FIG. 5. The plastic plates may also be held firmly by friction or other mechanical means, other than the previous mentioned adhesive, for slidable insertion into, and removal from, the shoe sole assembly 4' to accommodate replacing the wave springs with other wave springs of different spring rates. Furthermore, the plastic plates may be concatenated, giving rise to a plastic member that extends from the heel area to the ball of the foot area of the shoe sole assembly. A shoe sole assembly designed to accept the plastic member may be equipped with a single vacuity that extends most of the full length of the shoe sole assembly.

The wave springs used in the depicted embodiment of the invention are made of spring steel with inner and outer diameters, transverse thicknesses, peak and trough heights and quantities chosen so as to provide spring rates for wave spring 15 and 19 of 600 lb/in and 500 lb/in respectively.

The design parameters and materials of the wave springs are selected so as to provide springs of different spring forces and other characteristics. For example, other metallic and non-metallic materials, polymers, and composites may be selected for different weight and strength characteristics. Also, the design parameters of the wave springs may be altered to provide varying strength, deflection, and load characteristics. Further, the embodiment of this invention is described in terms of a single cushion shoe. It should be understood that the companion cushion shoe will be of similar design and construction.

Figure 8:
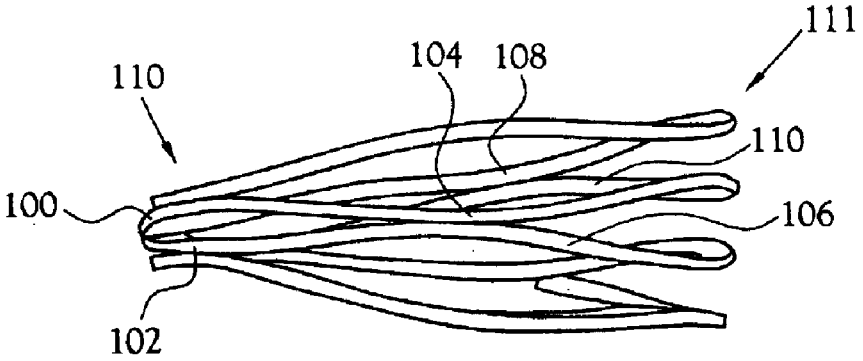
FIG. 8 illustrates a side elevation view of a wave spring with a first side compressed.
Figure 9:
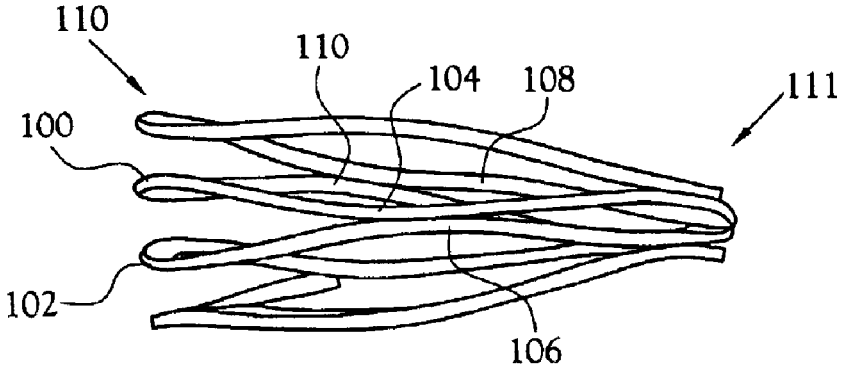
FIG. 9 illustrates a side elevation view of a wave spring with a second side compressed.

The sequential operation of the multi-turn wave spring 15 within a running shoe 2 is illustrated in FIGS. 3, 8 and 9. In FIG. 3, the spring 15 is illustrated in its relaxed condition, as it would be when the shoe is elevated off the ground. As the heel region 8C of the shoe 2 strikes the ground, the first side 110 is compressed. (See FIG. 8) Compression of the first side 110 transfers expansion pressure to the second side 111 through the pivotal contacts between the crests 106 and 110 with the troughs 104 and 108, respectively. As the rolling motion of the footstrike continues, the spring 15 returns to the condition illustrated in FIG. 3. Then the second side 111 is compressed. (See FIG. 9.) Compression of the second side 111 transfers expansion pressure to the first side 110 through the pivotal contacts between the crests 106 and 110 with the troughs 104 and 108, respectively. As the heel region 8C lifts off the ground, the spring 15 returns to the condition illustrated in FIG. 3. The spring 19 in the ball region 10C operates in a similar manner sequentially after the spring 15 to provide cushioning and energy return responsive to a rolling footstrike. The operation of the springs 15 and 19 is similar for both longitudinal and lateral movement to allow for quick lateral movements in activities such as basketball and tennis.

The operation of the SCS 2 will now be explained in view of the shoe of FIG. 1. When a pair of spring cushioned shoes is placed in use by a user, for example a runner, the region of the shoe containing wave spring 15 strikes the running surface first. The strike force applied by the calcaneus portion of the foot compresses the wave spring to a prescribed height before the foot is brought to rest and the body mass is dynamically transferred to the metatarsal region of the foot in contact with the surface where the wave spring 19 becomes compressed. When the body mass is transferred to the metatarsal region of the foot, wave spring 15 which was in the initial footstrike undergoes a compress--recoil cycle. As the user lifts the metatarsal region of the foot, energy is transferred to this region as wave spring 19 recoils. Thus, wave springs 15 and 19 both provide cushioning and energy return to the user of the SCS 2.

During footstrike (whether from jumping or running), peak forces of several times the body weight are imparted to the wave springs. Assuming that an average user of the shoes weighs 165 lbs, average peak forces greater than 300 lbf/in. may be imparted to the wave springs. Hence, the previous mentioned spring rates could be used for a 165-lb person.

Wave springs are ideal for use in this limited space application. Conventional spring methods are inferior in shoe cushioning applications because of the limited combination of force, deflection, and space requirements.

While a preferred embodiment has been shown and described, it will be understood that it is not intended to limit the disclosure, but rather it is intended to cover all modifications and alternate methods falling within the spirit and the scope of the invention as defined in the appended claims.

What is claimed is:

1. A sole assembly for an article of footwear comprising:

a sole having a heel region and a ball region;

a first multi-turn wave spring disposed within the sole, said first multi-turn wave spring comprising an upper turn and a lower turn, said upper turn being in pivotal contact with said lower turn to define a first side and an opposing second side of said multi-turn wave spring, whereby compression of said first side causes expansion pressure on said second side and compression of said second side causes expansion pressure on said first side to provide cushioning and energy return responsive to a rolling footstrike.

2. A sole assembly in accordance with claim 1 wherein said first multi-turn wave spring is located in said heel region of said sole.

3. A sole assembly in accordance with claim 1 wherein said sole defines a first vacuity and said first multi-turn wave spring is disposed within the first vacuity.

4. A sole assembly in accordance with claim 1 wherein said first multi-turn wave spring is located in said ball region of said sole.

5. A sole assembly in accordance with claim 1 wherein said first multi-turn wave spring defines a cylindrical axis substantially perpendicular to said sole.

6. A sole assembly in accordance with claim 1 and further comprising a second multi-turn wave spring disposed within the sole, said second multi-turn wave spring comprising an upper turn and a lower turn, said upper turn being in pivotal contact with said lower turn to define a first side and an opposing second side of said second multi-turn wave spring, whereby compression of said first side of said second multi-turn wave spring causes expansion pressure on said second side of said second multi-turn wave spring and compression of said second side of said second multi-turn wave spring causes expansion pressure on said first side of said second multi-turn wave spring to provide cushioning and energy return responsive to a rolling footstrike.

7. A sole assembly in accordance with claim 6 wherein said second wave spring is located in said ball region of said sole.

8. A sole assembly in accordance with claim 6 wherein said sole defines a second vacuity and said second multi-turn wave spring is disposed within the second vacuity.

9. A sole assembly in accordance with claim 6 wherein said first multi-turn wave spring defines a cylindrical axis substantially perpendicular to said sole.

10. A spring cushioned shoe comprising an upper support member for receiving a human foot and a sole assembly in accordance with claim 1.

11. A spring cushioned shoe comprising an upper support member for receiving a human foot and a sole assembly in accordance with claim 6.

* * * * *